US007509782B2

(12) United States Patent
Colosimo et al.

(10) Patent No.: US 7,509,782 B2
(45) Date of Patent: Mar. 31, 2009

(54) METAL FRAMED FLOOR PANEL HAVING FLANGE OUTWARD OF RIB WITH U-SHAPED PORTION OF GASKET OVER TOP OF RIB, PORTION OF GASKET BETWEEN RIB AND FLANGE, AND CONVEX SEALING PORTION OF GASKET BELOW FLANGE AND OUTWARD OF RIB

(75) Inventors: Sam Colosimo, Woodbridge (CA); Vince Derrick, Milton (CA)

(73) Assignee: Tate ASP Access Floors, Inc., Jessup, MD (US)

( * ) Notice: Subject to any disclaimer, the term of this patent is extended or adjusted under 35 U.S.C. 154(b) by 490 days.

(21) Appl. No.: 10/823,727

(22) Filed: Apr. 14, 2004

(65) Prior Publication Data

US 2005/0246984 A1 Nov. 10, 2005

(30) Foreign Application Priority Data

Apr. 13, 2004 (CA) ..... 2,464,062

(51) Int. Cl.
*E04C 2/34* (2006.01)
*E04F 15/024* (2006.01)

(52) U.S. Cl. ..... 52/792.1; 52/126.6

(58) Field of Classification Search ..... 52/126.5, 52/126.6, 263, 717.1, 220.5, 126.2, 792.1, 52/792.11; 108/27, 64, 55.1, 54.1
See application file for complete search history.

(56) References Cited

U.S. PATENT DOCUMENTS 2,278,331 A * 3/1942 Meyercord ..... 52/573.1
2,956,653 A * 10/1960 Liskey, jr. ..... 52/396.06
3,011,222 A 12/1961 Spiselman
3,025,934 A * 3/1962 Spiselman et al. ..... 52/126.6
3,150,748 A * 9/1964 Liskey, Jr. ..... 52/396.04
3,178,026 A * 4/1965 Christy ..... 210/293
3,236,018 A * 2/1966 Graham et al. ..... 52/791.1
3,396,501 A 8/1968 Tate et al.
3,443,349 A * 5/1969 Mahle ..... 52/309.13
3,526,071 A * 9/1970 Watanabe ..... 52/396.06
3,548,559 A * 12/1970 Levine et al. ..... 52/782.1
3,616,584 A * 11/1971 Sartori et al. ..... 52/126.6
3,696,578 A * 10/1972 Swensen et al. ..... 52/789.1
3,707,060 A * 12/1972 Jansen, Jr. ..... 52/241
3,759,005 A 9/1973 Smith
3,811,237 A * 5/1974 Bettinger ..... 52/126.6

(Continued)

FOREIGN PATENT DOCUMENTS

CA 869215 4/1971

(Continued)

*Primary Examiner*—Gay Ann Spahn
(74) *Attorney, Agent, or Firm*—Oliff & Berridge, PLC

(57) ABSTRACT

An access floor assembly is provided that comprises a plurality of abutting access floor panels that are attached to a plurality of pedestals. A resilient and flexible gasket is provided between the abutting floor panels to provide an effective seal between the panels. The effective seal allows a pre-determined pressure to be maintained in a plenum located between the access floor panels and a sub-floor. Air under pressure in the plenum may be delivered in a controlled and consistent manner from the plenum to a space above the access floor assembly.

5 Claims, 7 Drawing Sheets

U.S. PATENT DOCUMENTS

| | | | | | |
|---|---|---|---|---|---|
| 3,885,362 | A | * | 5/1975 | Pollock | 52/126.7 |
| 4,035,967 | A | * | 7/1977 | Harvey | 52/126.6 |
| 4,085,557 | A | * | 4/1978 | Tharp | 52/263 |
| 4,142,341 | A | * | 3/1979 | Mott | 52/263 |
| 4,279,109 | A | * | 7/1981 | Madl, Jr. | 52/263 |
| 4,295,319 | A | * | 10/1981 | Griffin | 52/783.1 |
| 4,390,580 | A | * | 6/1983 | Donovan et al. | 428/68 |
| 4,447,998 | A | * | 5/1984 | Griffin | 52/126.6 |
| 4,453,365 | A | * | 6/1984 | Gladden | 52/717.05 |
| 4,461,131 | A | | 7/1984 | Pressell | |
| 4,574,555 | A | | 3/1986 | Cline | |
| 4,637,181 | A | * | 1/1987 | Cohen | 52/126.5 |
| 4,656,795 | A | * | 4/1987 | Albrecht et al. | 52/126.6 |
| 4,676,036 | A | * | 6/1987 | Bessert | 52/126.6 |
| 4,748,789 | A | * | 6/1988 | Hedley | 52/789.1 |
| 4,850,176 | A | | 7/1989 | Munsey et al. | |
| 4,922,670 | A | * | 5/1990 | Naka et al. | 52/126.6 |
| 4,945,701 | A | * | 8/1990 | Bell et al. | 52/601 |
| 5,046,291 | A | * | 9/1991 | Narayan | 52/126.6 |
| 5,048,242 | A | * | 9/1991 | Cline | 52/126.6 |
| 5,049,700 | A | * | 9/1991 | Kobayashi et al. | 174/482 |
| 5,111,630 | A | | 5/1992 | Munsey et al. | |
| 5,333,423 | A | * | 8/1994 | Propst | 52/126.6 |
| 5,614,695 | A | * | 3/1997 | Benito Navazo | 174/480 |
| 5,791,096 | A | * | 8/1998 | Chen | 52/126.6 |
| 6,189,289 | B1 | * | 2/2001 | Quaglia et al. | 52/764 |
| 6,519,902 | B1 | | 2/2003 | Scissom | |
| 6,584,739 | B2 | | 7/2003 | Zeif | |
| 6,694,689 | B1 | * | 2/2004 | Scott et al. | 52/392 |
| 2002/0026757 | A1 | | 3/2002 | Scissom et al. | |
| 2002/0194806 | A1 | * | 12/2002 | Roen | 52/506.01 |
| 2003/0009966 | A1 | * | 1/2003 | Rieke et al. | 52/309.8 |
| 2003/0051420 | A1 | | 3/2003 | Leon | |
| 2005/0016107 | A1 | * | 1/2005 | Rosenthal et al. | 52/578 |

FOREIGN PATENT DOCUMENTS

| | | | | |
|---|---|---|---|---|
| CA | 946578 | | | 5/1974 |
| CA | 2339450 | | | 9/2001 |
| CA | 2347593 | | | 11/2001 |
| CA | 2400878 | | | 4/2003 |
| CA | 2400873 | | | 5/2003 |
| DE | 37 31 126 | A1 | * | 3/1989 |
| EP | 0 128 428 | A2 | * | 12/1984 |
| EP | 0 313 485 | A1 | * | 4/1989 |
| FR | 2 624 538 | A1 | * | 6/1989 |
| GB | 2 099 039 | A | * | 12/1982 |
| GB | 2 157 734 | A | * | 10/1985 |
| JP | 2000-226928 | A | * | 8/2000 |

* cited by examiner

METAL FRAMED FLOOR PANEL HAVING FLANGE OUTWARD OF RIB WITH U-SHAPED PORTION OF GASKET OVER TOP OF RIB, PORTION OF GASKET BETWEEN RIB AND FLANGE, AND CONVEX SEALING PORTION OF GASKET BELOW FLANGE AND OUTWARD OF RIB

FIELD OF THE INVENTION

The present invention relates to access floor systems.

BACKGROUND OF THE INVENTION

Access floor systems are widely used in modem office buildings. These floors are also referred to as elevated floors or computer floors. Access floor systems were initially used in computer rooms for cooling applications because computers generate a great deal of heat and to accommodate the extensive electrical wiring requirements. Today, access floors are also widely used in commercial office construction. Access floor systems provide a space between the access floor and a base floor to accommodate the electrical and mechanical systems, building controls, communication wiring and other components required for operating the building. Access floor panels are removable which allows easy access to the wiring, components and electrical outlets.

The flooring of access floor systems is provided by a plurality of square floor panels. Access floor systems include a plurality of pedestals that support the square shaped floor panels. The pedestals of access floor systems in the past supported a plurality of metal stringers that formed a frame for supporting the perimeter of each of the square floor panels. U.S. Pat. No. 3,396,501 provides an example of such a stringer-based system. Stringer based systems are disadvantageous however because they are expensive and the stringer frame imposes a permanently installed structure that makes access to components and services under the floor more difficult. Stringer less systems have been developed wherein the pedestals directly support the corners of the square floor panels. Canadian Patent No. 946,578 provides an example of such a system. This patent describes an access floor system that can be structured as either a stringer type assembly or a stringer less type assembly.

The floor panels of these systems may leave a gap around the perimeter of the floor panels that permits a flow of air through the access floor. In buildings with under floor air this may be disadvantageous as this airflow loss makes it difficult and or inefficient to maintain air pressure under the access floor. This is a significant drawback because a specified air pressure is required beneath the access floor for ventilation purposes in order to deliver air from beneath the access floor to the space above the floor in a consistent and controlled manner. However, air cannot be delivered in an efficient way through diffusers in the floor panels in an access floor if there is a high level of leakage in through the floor panel edges.

There is therefore a need for a modular stringer less access floor system wherein the floor panels are sealed effectively to provide an air pressure beneath the access floor that permits air to be delivered to a space from beneath the floor in a controlled and efficient manner.

SUMMARY OF THE INVENTION

The present invention provides a stringer less modular access floor having floor panels that are effectively sealed to maintain a specified pressure level beneath the access floor for delivering air to a space above the floor in a controlled manner.

The access floor system of the present invention comprises a plurality of pedestals that support a plurality of access floor panels. The panels are sealed by flexible self-adjusting gaskets.

According to one aspect of the present invention there is provided an access floor assembly for installation on a sub-floor. The access floor assembly comprises a plurality of elongate support members. Each of the support members has a base for attachment to the sub-floor, and a head longitudinally spaced from the base. The access floor assembly also has a plurality of access floor panels. Each of the access floor panels defines a top planar surface and an opposed bottom planar surface. Each of the bottom surfaces is detachably connectable to the head of at least one of the support members. Each of the access floor panels defines a plurality of peripheral edges for abutting a peripheral edge of a respective access floor panel. The access floor assembly has a plurality of gaskets for providing an airtight seal between the peripheral edges of abutting access floor panels. Each of the gaskets has a first portion for attachment to one of the floor panels and a flexible and resilient sealing portion for creating a seal between the peripheral edges of the abutting access floor panels.

According to another aspect of the present invention there is provided an access floor panel for attachment to a pedestal of an access floor assembly. The access floor panel comprises a top planar surface and an opposed bottom planar surface. The bottom surface is detachably connectable to the pedestal. The access floor panel defines a plurality of peripheral edges and a plurality of gaskets. One of the gaskets is attached to each of the peripheral edges. The gaskets each have a first portion attached to one of the peripheral edges and a flexible and resilient sealing portion adapted to create a seal between the peripheral edge to which the first portion is attached and a peripheral edge of an abutting access floor panel.

BRIEF DESCRIPTION OF THE DRAWINGS

In drawings which illustrate by way of example only a preferred embodiment of the invention.

DETAILED DESCRIPTION OF THE INVENTION

Figure 1:
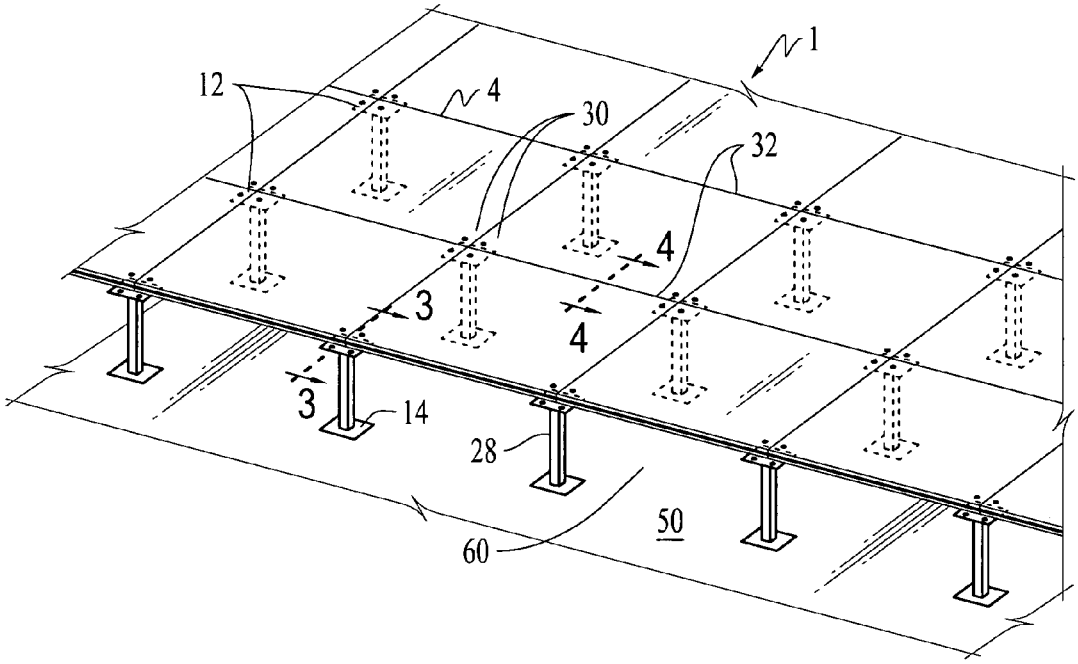
FIG. 1 is a front perspective view of a modular access system of the present invention.
Figure 2:
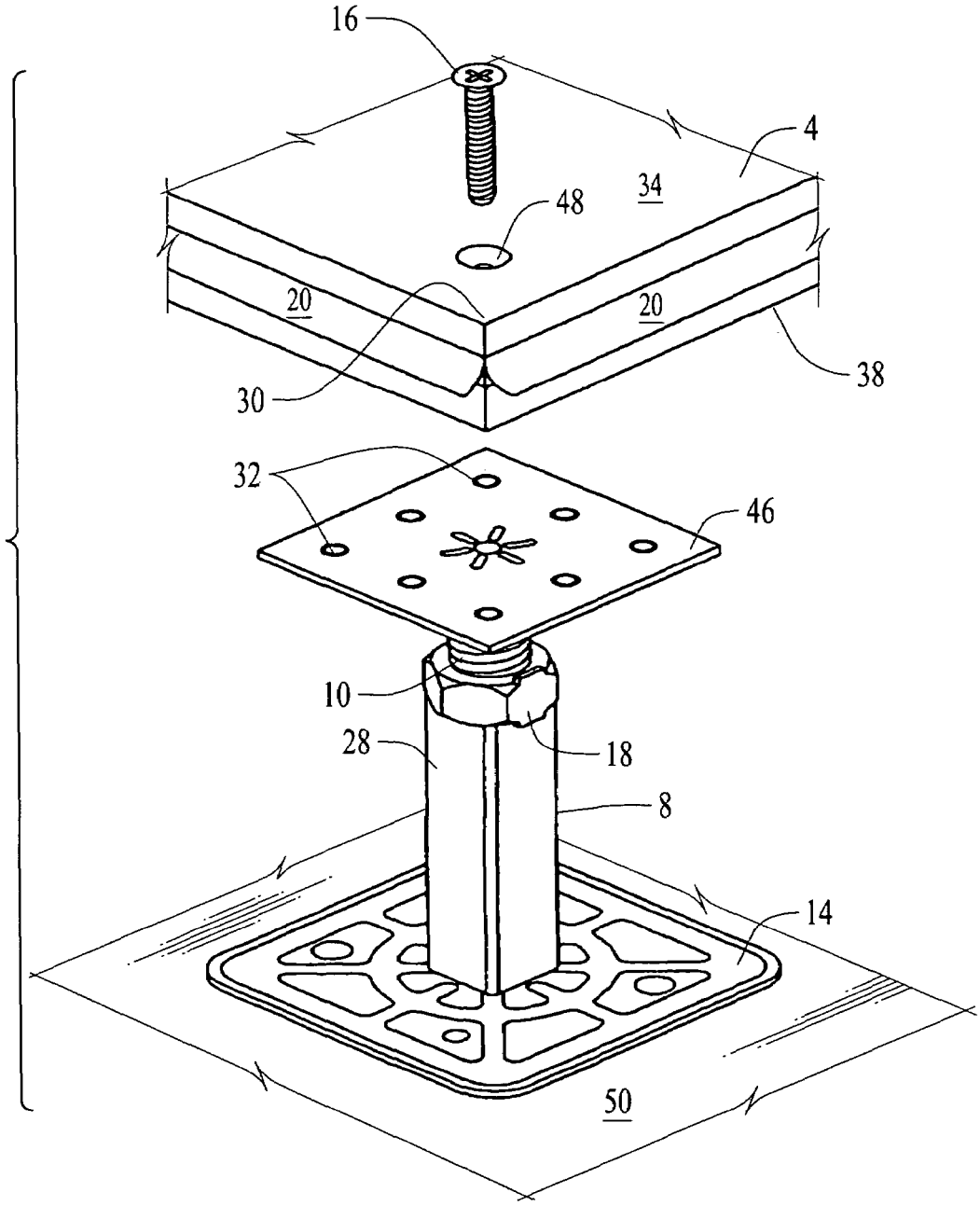
FIG. 2 is an exploded view of a pedestal and floor panel of the present invention.
Figure 3:
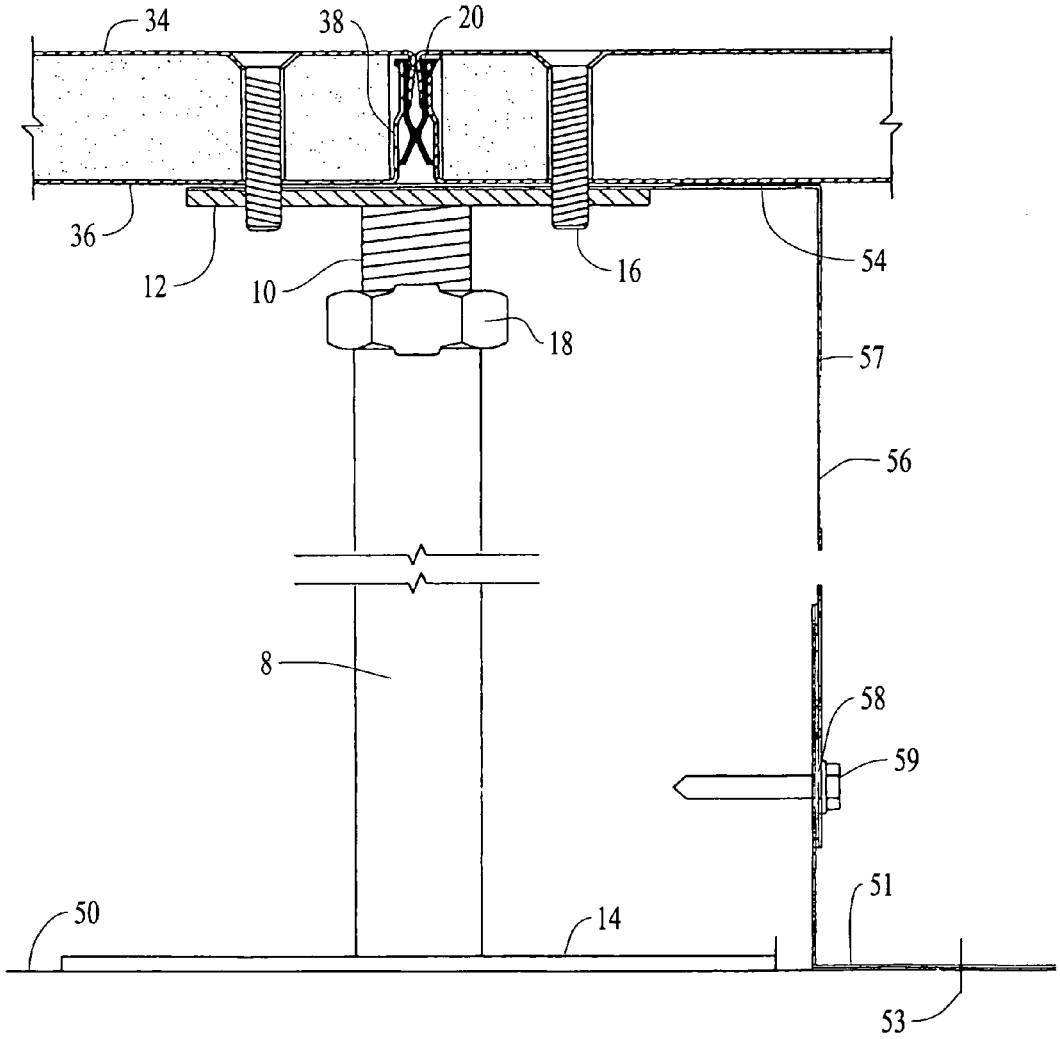
FIG. 3 is a cross-sectional view taken along lines 3-3 of FIG. 1.
Figure 4:
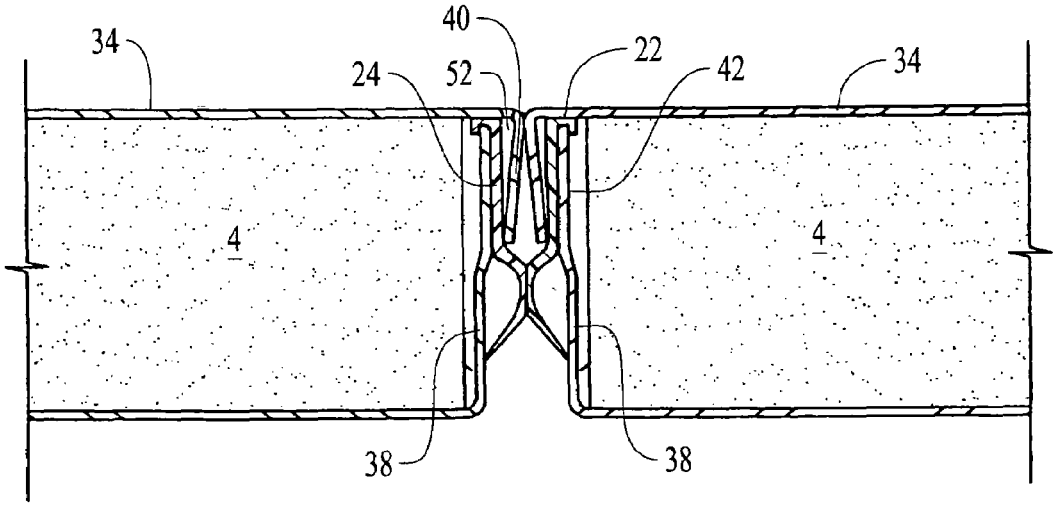
FIG. 4 is a cross-sectional view taken along lines 4-4 of FIG. 1.

As shown in FIG. 1, modular access floor assembly 1 comprises a plurality of floor panels 4. The floor panels 4 are preferably square shaped having four peripheral edges 38 and four corner portions 30. Other embodiments of the present invention may have floor panels with three peripheral edges. The floor panels 4 preferably define bores 48 through the corner portions 30 as seen in FIG. 2. Each of the floor panels 4 has a top planar surface 34 and a bottom planar surface 36. The floor panels 4 abut respective floor panels 4 along peripheral edges 38 of the floor panels 4. As best shown in FIGS. 3 and 4, each peripheral edge 38 has a flange portion 40 and a rib portion 42. Each peripheral edge 38 defines a channel 52 between the flange portion 40 and the rib portion 42.

The floor panels are preferably constructed of a metal frame with a centre core. The centre core may include a variety of materials including wood. The surface is preferably applied with an adhesive. Each of the floor panels preferably measures approximately 24" by 24" and has a thickness of approximately 1" (25.4 mm). A person skilled in the art will appreciate that the floor panels can be made with various measurements and from various materials known in the art.

Air is moved from the plenum area 60 to the surface above by various means such as passive and active devices. A passive method is by diffuser and an active method is by means of a mechanical floor diffuser commonly known as a VAV (variable air volume). Both systems require that a predetermined pressure be maintained in the plenum 60 located below the access floor.

Figure 6:
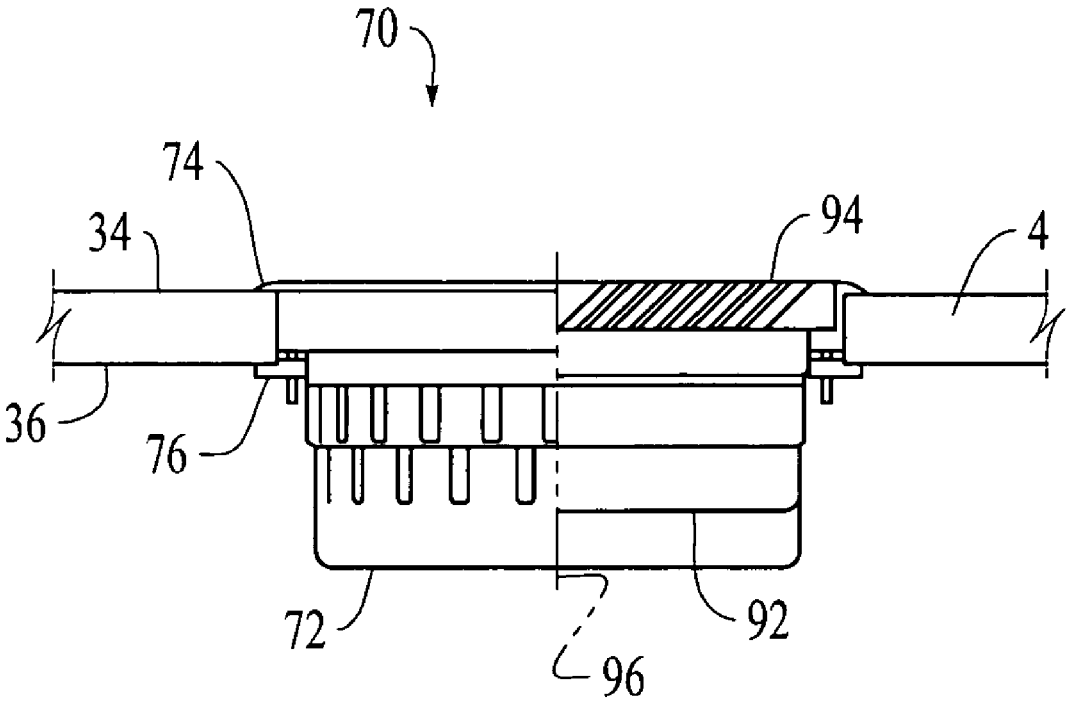
FIG. 6 is a partial sectional view showing a diffuser installed in floor panel of the present invention and reveals interior details to the right of phantom line 96.
Figure 7:
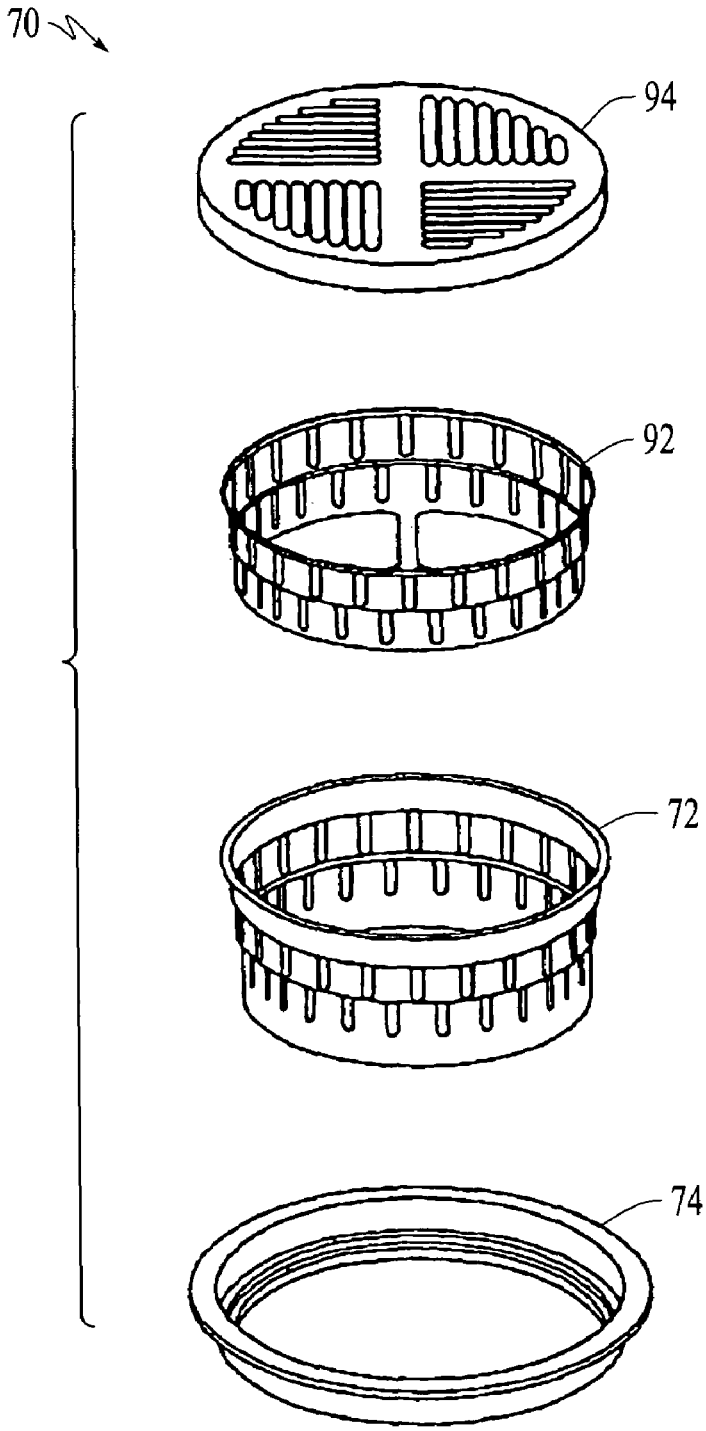
FIG. 7 is an exploded view of the diffuser.

The floor panels 4 preferably have diffusers 70 installed therein for allowing air to pass through in a controlled manner when the air has reached a pre-determined pressure level. The diffusers are installed into the floor panels according to methods known in the art such that air can move transversely through the plane of the floor panels. FIG. 6 illustrates how a diffuser 70 can be installed into a floor panel 4. The diffuser 70 has a carpet flange 74 that abuts the top surface 34 of the floor panel 4. A mounting clamp 76 is attached to the diffuser 70 and abuts the bottom surface 36 of the floor panel 4. The diffuser may have a dust trap 72 that preferably rotates to adjust outlet airflow. FIG. 7 is an exploded view of a diffuser that is used as part of the present invention. The diffuser 70 has the dust trap 72 that receives an adjustable damper 92. The diffuser 70 also has the carpet flange 74 and a diffuser lid 94.

A mechanical floor diffuser may be employed that is commonly referred to as a VAV (variable air volume). This diffuser may be installed into the floor according to methods known in the art such that air is moved transversely through the floor at various controlled delivery volumes.

As best shown in FIGS. 3 and 4, a gasket 20 is attached to each of the four peripheral edges 38 of the floor panels 4. Each gasket 20 extends along the entire length of the peripheral edge 38 to which it is attached. The gasket 20 therefore forms a trim along the length of the peripheral edge 38 of the floor panel 4 to which it is attached, as shown in FIG. 2.

Figure 5:
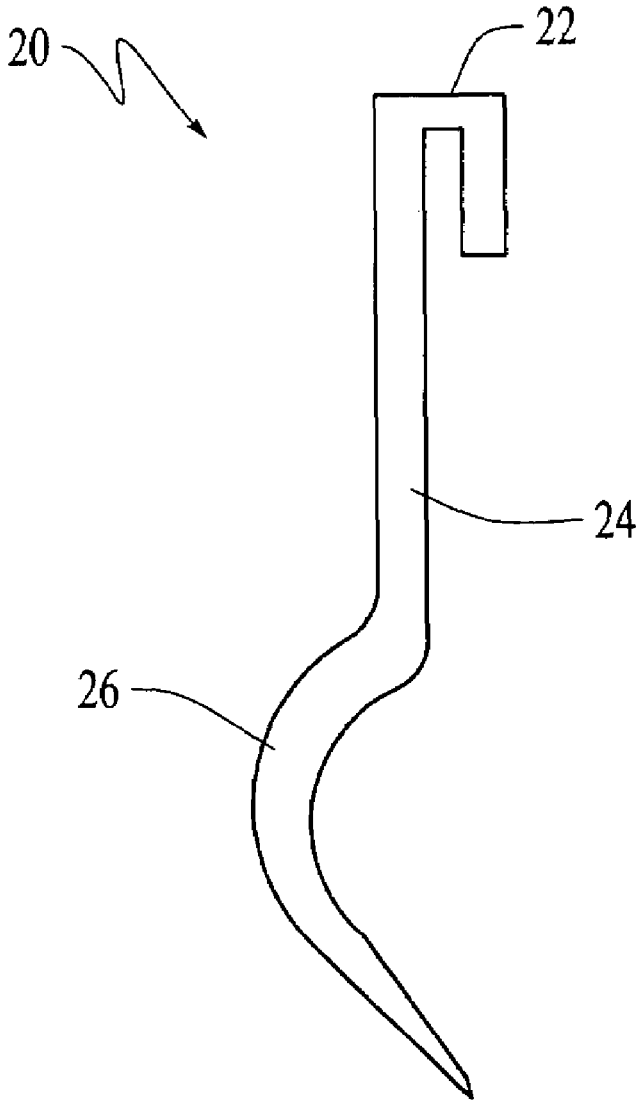
FIG. 5 is a side profile of a gasket of the present invention.

The gasket 20 is shown in side profile in FIG. 5. The gasket 20 has a flange portion 22, a trim portion 24 and a resilient sealing portion 26. The resilient sealing portion is preferably concave in shape and preferably protrudes beyond the trim portion 24.

As shown in FIGS. 3 and 4, the trim portion 24 of the gasket is received in the channel 52 of the peripheral edge 38 to which it is attached. The flange portion 22 of the gasket is attached to the rib portion 42 of the floor panel 4. The flange portion 40 of the peripheral edge 38 abuts trim portion 24 of the gasket 20 such that the gasket is securely attached to the floor panel 4 in the channel 52.

The gasket 20 is constructed of a flexible and resilient material that is preferably a synthetic polymer such as flexible polyvinyl chloride. The gasket 20 may also be constructed of other flexible and resilient materials. The gasket member is preferably installed onto the peripheral edge 38 during manufacture so that it cannot be removed. The gasket 20 appears as a trim along the length of the peripheral edge 38 to which it is attached.

In an alternate embodiment of the invention, the gasket may be constructed of other synthetic, organic or inorganic materials. In this alternate embodiment, the gasket may be attached to the floor panel 4 by way of an adhesive.

The access floor assembly shown in FIG. 1 includes a plurality of pedestals 8 that function as support members for the access floor system. The pedestals each have a base plate 14 that attaches to a sub-floor 50 of a building shown in FIG. 2. The base is connected to an elongate post 28. The post 28 terminates in a threaded rod portion 10 that attaches to a head plate 12. An adjusting nut 18 is attached to the threaded rod portion 10. The nut has projections that prevent it from rotating on the post 28. The head plate 12 is planar and preferably square shaped. The head plate preferably defines a plurality of threaded bores 32 about a periphery thereof. Most preferably, the head plate 12 has four corners 46 and defines a threaded bore 32 near each of the four corners 46. As shown in FIG. 2, a corner 30 of one of the floor panels 4 preferably attaches to a corner 46 of the head plate. A threaded fastener 16 preferably attaches the floor panels 4 to the head plates 12 through clearance holes 48 and threaded bores 32. The clearance hole 48 is preferably 5/16" in diameter. As shown in FIG. 2, each head plate 12 is adapted to attach to four floor panels 4 by attachment through the threaded bores 32.

The base and head plate are made in varying thicknesses and dimensions depending on the various requirements and conditions. The post 28 can be any height for the purposes of the present invention. The post, base and head plates are all preferably constructed of steel, although they can be made from other materials The access floor system of the present invention is a modular system that can be assembled and disassembled. It is useful to disassemble portions the access floor in order to install cables below the access floor, access services below the access floor or to work under the access floor.

In an assembled position, the access floor assembly comprises a plurality of abutting floor panels 4 that form a continuous floor as shown in FIG. 1. With the exception of a floor panel 4 located at one of the peripheries, each of the floor panels 4 abuts four other floor panels. With the further exception of a floor panel 4 located at one of the peripheries of the access floor assembly 1, each of the four peripheral edges 38 of each floor panel 4 abuts a peripheral edge 38 of another floor panel 4.

In the assembled position, each of the four corners 30 of each floor panel 4 is attached to a different head plate 12 of a different pedestal 8. Therefore, when the access floor assembly 1 is in the assembled position, with the exception of the pedestals 8 located along the periphery of the access floor assembly 1, each pedestal 8 is attached to four different floor panels 4. Preferably, the four corners 46 of the head plates 12 are each attached to a corner 30 of a different floor panel 4.

As shown in FIGS. 3 and 4, in the assembled position, the peripheral edges 38 of respective floor panels 4 are in abutment. The sealing portions 26 of respective gasket members 20 of the respective floor panels 4 are also in abutment. The resilient and flexible sealing portions 26 compress and flatten when they are in abutment to form a tight seal. Because the sealing portion 26 is resilient and flexible, the sealing portion 26 returns to its original position as shown in FIG. 5, without any damage to the gasket when a floor panel 4 is removed from the assembly 1. Therefore, the floor panels 4 can be removed from the access floor assembly 1 and replaced without affecting the performance of the seal provided by abutting gasket members 20.

The access floor assembly shown in FIG. 1 defines a plenum 60 between the access floor and the sub-floor. The plenum 60 can supply air-conditioned air to the space above the access floor through the diffusers. When the access floor assembly 1 is assembled, the air in the plenum 60 is maintained under pressure due the seals provided by the gaskets 20. The pressure in the plenum is maintained in a predetermined design range. At this pressure level, air is delivered to the space above the access floor in a controlled manner through the diffusers or mechanical devices.

The seal between the abutting floor panels 4 provided by the abutting gasket members 20 allows an air leakage rate of air from the plenum through the access floor panels 4 to be maintained at a minimum. As a result, it is possible to maintain the required pressure in the plenum for proper air circulation through the diffusers or mechanical devices without having to deliver an overly abundant volume of air to the plenum.

The access floor assembly 1 has a periphery and four peripheral sides. In some designs a plenum flashing 56 as shown in FIG. 3, is attached to each of the peripheral sides of the access floor system 1. The plenum flashing is preferably made of galvanized steel. The plenum flashing 56 has an upper portion 57 that is located near an underside 36 of the floor panel 4. A plenum gasket 54 is located between the underside 36 of the floor panel 4 and the upper portion 57 and forms a seal therebetween. An acoustic caulking 58 is preferably attached to the plenum flashing 56 by way of fastener 59. Preferably, the plenum flashing 56 has a base 51 that is attached to the sub-floor 50 by way of anchor members 53. Preferably the anchor members 53 are Hilti™ anchor members that are attached to the base every 24" along the length of the base. The plenum flashing 56 is preferably located ¼" from the base plate 14 of the nearest pedestal 8.

The access floor assembly can be readily disassembled. This is accomplished by removing one or more of the floor panels 4 from the head plates 46 to which they are attached by removing the fasteners 16. The removal of one or more of the floor panels 4 permits easy access to the plenum 60 beneath the floor for access to services and cables located beneath the floor. The pedestals 8 are fixed to the sub-floor 50 either with a conventional adhesive or by mechanical anchors. The pedestals 8 can be easily removed once the floor panels have been removed from the head plates. This is accomplished by loosening the adjusting nut 18. The pedestal head 12 can be removed when the floor panels 4 are removed. The pedestal base 14 is preferably glued to the sub-floor 50.

The floor panel 4 is preferably manufactured by forming a shaped flat sheet of metal into a bottom pan of approx. 24" square, with an approx 1" (25.4 mm) lip. This part is preferably applied on an interior surface with adhesive and a 1" (25.4 mm) centre core panel that is also preferably applied with an adhesive is placed into the bottom pan.

The gasket 20 is constructed from a flexible and resilient material that has a hooked upper section that is hooked over the top edge of the formed lip of the bottom pan. Prior to attachment to a floor panel, the edge trim is cut to an exact length. Four pieces of trim are attached as described on each of the four sides of the square panel bottom pan. When cutting gaskets to length, the ends are also cut to a shape.

A metal top pan, is also formed into a pan with a lip edge. This top pan is also applied inside with adhesive and then placed on top of a sub assembly of centre core, bottom pan, and trim.

Various embodiments of the present invention having been thus described in detail by way of example, it will be apparent to those skilled in the art that variations and modifications may be made without departing from the invention. The invention includes all such variations and modifications as fall within the scope of the appended claims.

We claim:

1. An access floor panel comprising a metal frame and at least one gasket, wherein the metal frame has a peripheral edge that includes a flange portion spaced outwardly from a rib portion, and wherein said at least one gasket extends around the periphery of said panel and comprises a first portion that engages said peripheral edge and is located between the flange portion and the rib portion and a flexible and resilient sealing portion extending downward from the first portion beyond the flange portion, the first portion having a top U-shaped portion that engages and surrounds a top edge of the rib portion of the peripheral edge of the panel, and the sealing portion forms a lowermost portion of the gasket defined by a convex sealing surface located below the flange portion.

2. An access floor panel according to claim 1 wherein the flange portion and the rib portion each have a substantially vertical portion in use and form a channel therebetween, said first portion of said at least one gasket being located in said channel.

3. An access floor panel according to claim 1 wherein the first portion forcibly engages the rib portion.

4. An access floor panel according to claim 1, wherein the convex sealing surface has a convex outer surface and a corresponding concave inner surface.

5. An access floor panel according to claim 4, wherein the convex sealing surface has a substantially constant thickness.

* * * * *